US009457993B2

(12) United States Patent
Somma et al.

(10) Patent No.: US 9,457,993 B2
(45) Date of Patent: Oct. 4, 2016

(54) ELEVATOR

(75) Inventors: Tuuli Somma, Helsinki (FI); Andrea Fasoli, Rho (Mi) (IT); Timo Manner, Klaukkala (FI); Matti Räsänen, Hyvinkää (FI); Osmo Björni, Hyvinkää (FI); Paula Bello, Helsinki (FI); Juha Mielonen, Vantaa (FI); Razvan Albu, Hyvinkää (FI); Natarajan Nithil Karimpanackal, Helsinko (FI)

(73) Assignee: KONE CORPORATION, Helsinki (FI)

( * ) Notice: Subject to any disclaimer, the term of this patent is extended or adjusted under 35 U.S.C. 154(b) by 580 days.

(21) Appl. No.: 13/979,202

(22) PCT Filed: Apr. 13, 2011

(86) PCT No.: PCT/FI2011/050322

§ 371 (c)(1),
(2), (4) Date: Jul. 11, 2013

(87) PCT Pub. No.: WO2012/049354

PCT Pub. Date: Apr. 19, 2012

(65) Prior Publication Data

US 2013/0327599 A1 Dec. 12, 2013

(30) Foreign Application Priority Data

Oct. 11, 2010 (FR) ..... 20 106044

(51) Int. Cl.
*B66B 11/02* (2006.01)

(52) U.S. Cl.
CPC ..... *B66B 11/0233* (2013.01); *B66B 11/0246* (2013.01); *B66B 11/0253* (2013.01); *B66B 11/0206* (2013.01); *B66B 11/0226* (2013.01)

(58) Field of Classification Search
CPC ..... B66B 11/0233; B66B 11/024; B66B 11/0246; B66B 11/0253; B66B 11/0226; B66B 11/0206
USPC ..... 187/401
See application file for complete search history.

(56) References Cited

U.S. PATENT DOCUMENTS 2,398,627 A * 4/1946 Disbro ..... B66B 11/024 422/121
4,126,210 A * 11/1978 Martin ..... B66B 11/0233 187/401

(Continued)

FOREIGN PATENT DOCUMENTS

EP 1 970 341 A1 9/2008
FR 1.371.974 9/1964

(Continued)

*Primary Examiner* — Michael Riegelman
(74) *Attorney, Agent, or Firm* — Birch, Stewart, Kolasch & Birch, LLP

(57) ABSTRACT

An elevator includes a hoisting machine, hoisting roping, an elevator hoistway, and an elevator car arranged to move in the elevator hoistway, and possibly a counterweight. The elevator car includes an interior, which is bounded by at least a roof of the elevator car, and a frame structure, which includes one or more parallel, horizontal, elongated roof beams in connection with the roof of the elevator car, preferably two parallel, horizontal, elongated roof beams, and which elevator includes one or more luminaires for lighting the interior of the elevator car. The structure of each of the one or more luminaires, preferably at least the light source and/or reflective surface of each of the one or more luminaires, is mainly by the side of the one or more roof beams.

28 Claims, 4 Drawing Sheets

(56) References Cited

Figure 1:
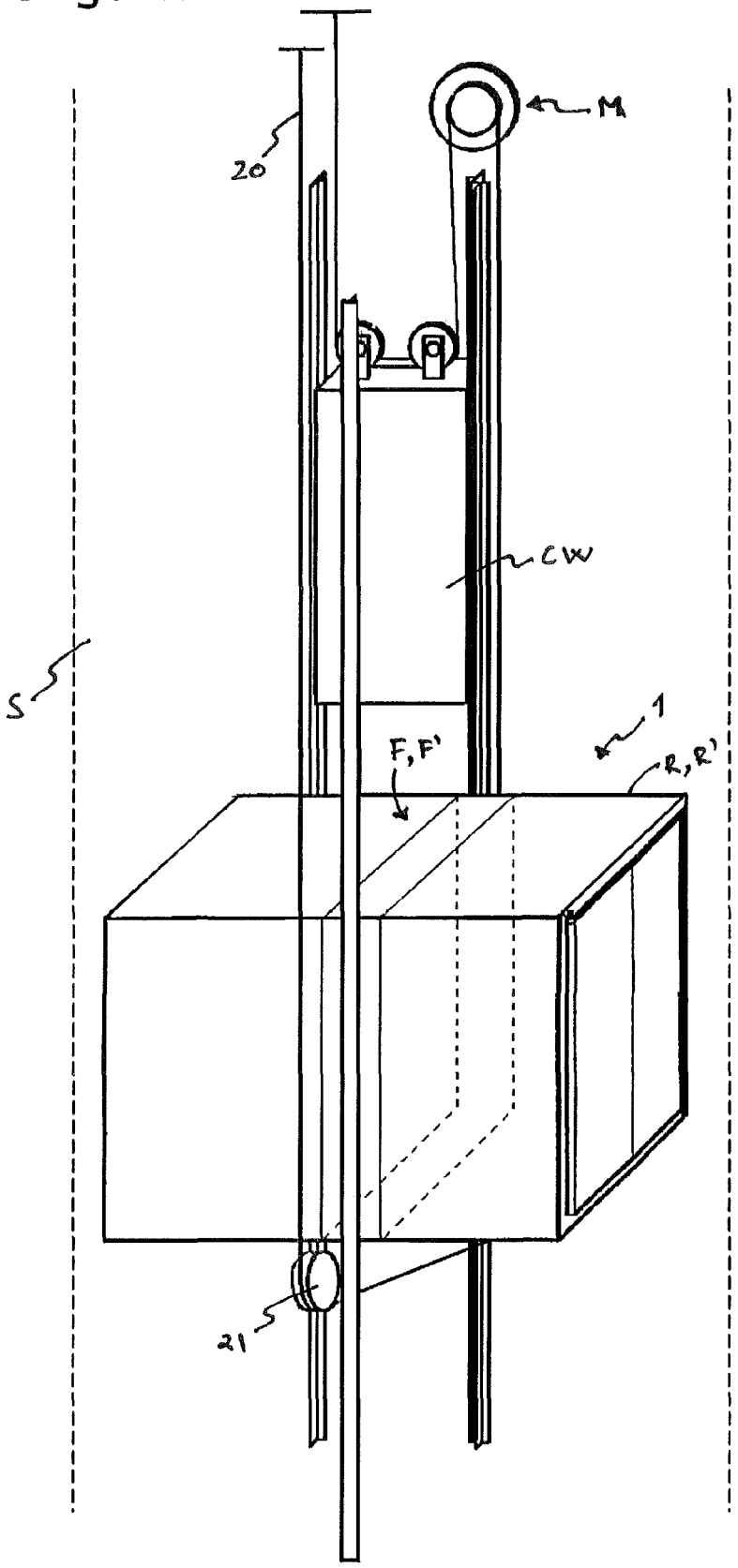

U.S. PATENT DOCUMENTS 4,749,061 A * 6/1988 Orndorff ..... B66B 11/0233 187/401
5,354,233 A * 10/1994 Mandy ..... F24F 7/007 187/393
5,412,542 A * 5/1995 Mandy ..... B66B 11/0233 187/390
6,367,581 B1 * 4/2002 Marler ..... B66B 11/0226 181/295
7,625,097 B2 * 12/2009 Endo ..... B66B 11/0233 313/485
2003/0006102 A1 * 1/2003 Bloch ..... B66B 11/0233 187/414
2004/0195049 A1 * 10/2004 Stobo ..... B66B 11/0253 187/401
2004/0262094 A1 * 12/2004 Yoon, II ..... B66B 11/024 187/401
2006/0070823 A1 * 4/2006 Huang ..... B66B 11/0233 187/401
2007/0251767 A1 * 11/2007 Yoon, II ..... B66B 11/0226 187/401
2010/0200339 A1 8/2010 Henseler
2013/0220742 A1 * 8/2013 Mielonen ..... B66B 11/0206 187/401
2014/0305749 A1 * 10/2014 Manner ..... B66B 11/0226 187/401
2015/0085476 A1 * 3/2015 Mandy ..... F21S 8/026 362/147

FOREIGN PATENT DOCUMENTS

JP 53-26064 3/1978
JP 58-36877 A 3/1983
JP 2000-289953 A 10/2000
JP 2001-139249 A 5/2001
JP 2003-26379 A 1/2003
JP 2005-145619 A 6/2005

* cited by examiner

ELEVATOR

FIELD OF THE INVENTION

The object of the invention is an elevator, more particularly an elevator applicable to the transporting of people and/or of freight.

BACKGROUND OF THE INVENTION

Elevator cars are conventionally formed to comprise a load-bearing frame structure, i.e. a car sling, which comprises a lower horizontal beam system and an upper horizontal beam system, as well as a vertical beam system of a first side and a vertical beam system of a second side, which beam systems are connected to each other so that they form a closed loop, inside which loop is an interior comprised in a car box fixed to the beam systems, which interior can receive goods and/or passengers for conveying them in the interior of the elevator car. Conventionally the car box has been essentially fully inside the aforementioned loop. Also known in the art are elevator cars, in which the beams participating in forming the aforementioned loop are integrated as a part of the wall structures, roof structures or floor structures that bound the interior of the car box. This type of solution is presented in, among others, publication EP1970341A1. In the solution in question, the upper horizontal beam system, inter alia, has been formed from two parallel horizontal beams, instead of one horizontal beam. In the solution presented the horizontal beams are on view, and components external to the elevator car, such as the car suspension means, are disposed alongside them.

The outer surface of the roof of the elevator car can be formed from plates that are firmly and permanently supported on the upper horizontal beam system. According to prior art, there is a separate ceiling panel in the elevator cars, below the upper horizontal beam system and the aforementioned plates forming the outer surface. The ceiling panel can be a single-piece or multi-piece ceiling panel, and the bottom surface of it forms a flat surface bounding the interior of the car. The ceiling panel is generally quite thin in terms of its thickness, e.g. a plate-type structure less than 50 mm thick, into which luminaires are fitted. For the servicing of the luminaires or other components of the roof or for opening the roof trap, the ceiling panel is generally fixed into its position with an openable locking, which can be opened from inside the car for taking the ceiling panel down. The ceiling panel structure has increased the total thickness of the roof structure by the amount of its own thickness plus possible fastening clearances.

One problem with prior-art solutions, among others, has been non-optimal space usage. More particularly the roof structure of an elevator car has not been optimized as an entity sufficiently from the standpoint of space usage. All the essential factors have not been simultaneously taken into account to an adequate extent, more particularly the placement of structures and components external to the elevator car, the space-efficiency and durable construction of the beam system of the frame structure, and the placement of structures and components inside the elevator car. Thus the overall structure of the roof has not been optimal, more particularly the free vertical space inside the elevator car and the free vertical space of the part of the hoistway above the elevator car have not been maximal.

AIM OF THE INVENTION

The aim of the invention is to eliminate, among others, the aforementioned drawbacks of prior-art solutions. More particularly the aim of the invention is to produce an elevator, the roof structure of the elevator car of which is extremely compact in the vertical direction. The aim of the invention is further to produce one or more of the following advantages, among others:

- An elevator is achieved in which the total thickness of the roof of an elevator car is low.
- An elevator is achieved in which the flat top surface of the roof, e.g. a standing surface for a serviceman, is very close to the bottom surface of the roof bounding the interior of the elevator car. In other words, the structural thickness between the interior of the elevator car and the standing platform is small and the parts of a serviceman that extend to highest above the elevator car, more particularly the head, can be kept as low as possible while working on the roof, e.g. when driving with service drive. The space needed by a serviceman does not therefore extend to high above the interior of the elevator car.
- An elevator is achieved, the structures of the roof structure of which, and the functions in connection with the roof of which, are more efficient than before in their space usage.
- An elevator is achieved, the distance between the bottom surface bounding the interior of said elevator and the roof of the elevator hoistway is small when the elevator car is in its upper position.
- An elevator with a low top clearance is achieved.

SUMMARY OF THE INVENTION

The invention is based on the concept that the space-efficiency of an elevator can be increased if the elevator car is formed to comprise one or more luminaires, the light source and/or reflective surface of which is disposed at least partly, preferably at least mainly, by the side of a horizontal beam in connection with the roof. In a basic embodiment of the concept according to the invention the elevator comprises an elevator hoistway or a corresponding space, and an elevator car arranged to move in the elevator hoistway, which elevator car comprises an interior, which is bounded at least by the ceiling of the elevator car, and a frame structure, which comprises one or more parallel, horizontal, elongated roof beams in connection with the roof of the elevator car, preferably two parallel, horizontal, elongated roof beams, and which elevator car comprises one or more luminaires for lighting the interior of the elevator car. The structure of each of the aforementioned one or more luminaires, preferably at least the light source and/or reflective surface of each of the aforementioned one or more luminaires, is at least partly, preferably mainly, by the side of the aforementioned one or more roof beams (i.e. in the vertical direction at the point of a roof beam of the aforementioned one or more roof beams). Thus the structure is indented in the vertical direction and very compact.

In a more refined embodiment of the concept according to the invention the aforementioned one or more roof beams comprise two parallel, horizontal, elongated roof beams in connection with the roof of the elevator car and at a horizontal distance from each other. The upper horizontal beam system of the frame structure is thus divided into a wider area, and its vertical height is low. When the luminaire structures are disposed beside the shallow upper horizontal beam system thus created, very significant space-saving is gained in relation to the total height of the roof. The aforementioned two beams are rigidly connected to each other.

In a more refined embodiment of the concept according to the invention the light source and/or reflective surface of the aforementioned one or more luminaires is wholly by the side of the aforementioned one or more roof beams. In this way the relative space-saving gained by a nested placement is maximal.

In a more refined embodiment of the concept according to the invention each aforementioned roof beam forms a part of the inner wall of the casing, into which casing a luminaire is disposed, preferably forming at least a part of the inner surface of the inner wall of the casing. In this way the beams also deliver this function. A separate casing for the luminaires is not needed. Thus a structure that is very close-fitting can be formed without bulky structures. The structure can be implemented very space-efficiently in both the vertical direction and the transverse direction.

In a more refined embodiment of the concept according to the invention the elevator car comprises a first luminaire or a plurality of first luminaires on a first side of the aforementioned one or more roof beams and a second luminaire or a plurality of second luminaires on a second side of the aforementioned one or more roof beams. In this way a luminaire array can be achieved wherein the light sources of the lighting are extensively distributed, with light coming from a number of points that are at a distance from each other, producing even lighting with simple and space-efficient arrangements. In this way space remains between the beams also in an embodiment having more than one beam, which space can be of advantage for other functions.

In amore refined embodiment of the concept according to the invention the aforementioned one or more roof beams comprise two parallel, horizontal, elongated roof beams in connection with the roof of the elevator car and at a horizontal distance from each other, and between the roof beams is a free space, in which space air between the interior and the elevator hoistway or data cables and/or electricity cables is/are led to travel, e.g. to devices, such as to a fan, to luminaires and/or to control means for service drive of the elevator, that are on the roof of the elevator car or in connection with the roof. As a result of utilization of the space, the other parts of the elevator car can be simpler than before. A very simple method of implementing ventilation is ventilation via the space between the beams. The input of fresh air can thus be simply made at a distance from the corners, e.g. fresh air can thus be input from the center area of the car, possibly distributing the air from a number of air intakes evenly into the center area of the elevator car. The space formed between the beams is of a preferred type, in which case conducting the air in the transverse direction of the car between the center areas and edge areas of the car is simple. The ventilation duct opening onto the hoistway side can be in the proximity of the edge of the car.

In a more refined embodiment of the concept according to the invention the elevator car further comprises a cover plate below the aforementioned at least one or more horizontal beams, which cover plate comprises a bottom surface, which forms a surface bounding the interior.

In a more refined embodiment of the concept according to the invention the elevator car comprises a cover plate below the aforementioned one or more horizontal beams, which cover plate comprises a bottom surface, which forms a surface bounding the interior, and ventilation ducts, which lead, preferably through the cover plate, from above the cover plate, from the aforementioned free space between the roof beams, into the interior of the elevator car. The aforementioned ventilation ducts are preferably apertures made in the cover plate.

In a more refined embodiment of the concept according to the invention the elevator car comprises a platform, which platform is preferably a standing platform, below which platform is the aforementioned free space between the roof beams.

In a more refined embodiment of the concept according to the invention the elevator car comprises ventilation ducts, which lead from the elevator hoistway into the aforementioned free space between the roof beams. The aforementioned ventilation ducts are preferably apertures made in the aforementioned platform A.

In a more refined embodiment of the concept according to the invention the structure of the aforementioned one or more luminaires extends to below the level of the flat bottom surface comprised in the cover plate bounding the interior.

In a more refined embodiment of the concept according to the invention the structure of the aforementioned one or more roof beams extends to below the level of the flat bottom surface comprised in the cover plate bounding the interior. A space is thus formed in the highest edge areas, into which space an object placed obliquely into, the elevator car can extend, which keeps the maximum dimension, of an object fitting inside the elevator car large. Thus the interior can extend to beside the aforementioned one or more roof beams, preferably on both sides, such that at the point of the aforementioned one or more roof beams an elongated ridge that extends downwards is formed. In this case space remains on both sides of the ridge, which space gives a passenger the impression of an extensive space. When the lighting is further in connection with the ridge, preferably lighting the upper planes of the ceiling, the impression of a high car is reinforced. At the same time the overall structure is very compact.

In a more refined embodiment of the concept according to the invention the roof comprises a platform, which comprises a flat top surface, which preferably functions as a standing surface, and that a structure of the aforementioned one or more luminaires, preferably a structure of a reflective surface and/or of a light source, extends to above the level of the top surface comprised in the roof. In this way the total thickness between the top surface and bottom surface of the roof can be kept small. A workman on the roof is able to stand very close to the top surface of the interior or alternatively projections in the roof of the elevator hoistway can get to very close to the top surface of the interior. Thus the roof of an elevator car does not remove from the elevator hoistway an essentially large vertical space from being used by other components or by people.

In a more refined embodiment of the concept according to the invention the cover plate is supported against the aforementioned one or more roof beams from below. The structure can thus be formed to be compact.

In a more refined embodiment of the concept according to the invention the elevator car comprises a first flat bottom surface bounding the interior on a first side of the aforementioned one or more beams, which first flat bottom surface is above the level of the bottom surface(s) of the aforementioned one or more beams, and a second flat bottom surface bounding the interior on a second side of the aforementioned one or more beams, which second flat bottom surface is above the level of the bottom surface of the aforementioned one or more beams. Thus the interior can extend to beside the aforementioned one or more roof beams, on both sides of the beam system formed by the aforementioned one or more beams such that at the point of the aforementioned one or more roof beams an elongated ridge p' that extends downwards is formed. In this case space remains on both sides of the ridge, which gives a passenger the impression of an extensive space. When the lighting is further in connection with the ridge, lighting the upper bottom surfaces of the ceiling, the impression of a high car is reinforced. A space is thus formed also in the highest edge areas, into which space an object placed obliquely into the elevator car can extend, which keeps the maximum dimension of an object fitting inside the elevator car large.

In a more refined embodiment of the concept according to the invention at the point of the aforementioned one or more roof beams an elongated ridge p' that extends downwards is formed. With this the aforementioned advantages are achieved.

In a more refined embodiment of the concept according to the invention the aforementioned cover plate comprises one or more translucent windows, via which the light of the aforementioned one or more luminaires is arranged to travel into the interior of the elevator car.

In a more refined embodiment of the concept according to the invention the aforementioned translucent window comprises a diffuser, e.g. a diffuser sheet or diffuser film, via which the light of the aforementioned luminaire is arranged to travel into the interior of the elevator car.

In a more refined embodiment of the concept according to the invention the aforementioned translucent window opens from the aforementioned one or more roof beams straight to the side or obliquely to the side. In this way an indirect route for the light can be achieved by reflecting via the walls and/or the top surface of the ceiling onto a passenger. The diffusibility of the light can thus be increased.

In a more refined embodiment of the concept according to the invention each of the aforementioned one or more luminaires are between a window and a roof beam.

In a more refined embodiment of the concept according to the invention each aforementioned roof beam is a channel open to the side, and one or more of the aforementioned luminaires are disposed on the channel side of each beam. The channel side has adequate space for installing the structure of a luminaire and to run electric cables to it. The structure of a luminaire can extend to inside the channel. Additionally, in an installation into cramped spaces the use of the tool of a fitter is made easier owing to even a small increase in extra space.

In a more refined embodiment of the concept according to the invention the aforementioned roof beams are profile beams, preferably open channel profile beams such as C-profile beams, or closed profile beams, which profile beams have essentially the same continuous cross-sectional profile in the longitudinal direction of the beam, the width/height ratio of which cross-section is preferably at least 0.5, preferably 0.5-1, more preferably 0.7-0.9. The cross-sectional profile continues as such preferably for essentially the whole length of the beam. Thus a shallow but rigid roof beam system is achieved, as a result of which one high beam can be divided into two shallow beams enabling a shallow overall structure of the roof.

In a more refined embodiment of the concept according to the invention it comprises two parallel roof beams in connection with the roof of the elevator car and at a horizontal distance from each other, between which roof beams is a trough, which has an upward-facing base surface, and that the elevator car comprises a side platform, which is preferably a standing platform, on the side of each roof beam, which side is on the opposite side to the aforementioned trough, and that each aforementioned roof beam together with its possible casing forms an elongated ridge p between a side platform and the trough, which ridge extends to above the base surface of the trough and to above the horizontal top surfaces of the side platforms, which surfaces are preferably standing surfaces. Thus the top surfaces of the roof can be brought close to the inside surfaces of the ceiling for improving vertical space-efficiency.

In a more refined embodiment of the concept according to the invention inside each aforementioned ridge p is at least partly one or more luminaires. When a beam and lighting are assembled side-by-side in one ridge, a number of functions are brought together and the space on the sides of them can effectively be taken into other use. In this way the vertical space-efficiency improves. The solution also clarifies the structure of the car, since the components are assembled into well-defined entities, clearly leaving completely free space for other use, which e.g. increases safety on the roof.

In a more refined embodiment of the concept according to the invention each aforementioned ridge p comprises a casing, which comprises a casing plate, which casing plate forms a part of the inner wall of the casing of a luminaire, into which casing the aforementioned luminaire, more particularly its light source, is disposed, and which casing can preferably be opened from above, from the roof of the car. Thus working with the luminaire is ergonomical.

In a more refined embodiment of the concept according to the invention the aforementioned frame structure also comprises the vertical beam(s) of a first side and the vertical beam(s) of a second side, between which is the aforementioned interior, and which beams are rigidly connected to each other by means of the aforementioned roof beams.

In a more refined embodiment of the concept according to the invention the frame structure comprises the aforementioned one or more roof beams, the vertical beams of a first side and of a second side, and a floor beam system, which are connected to each other such that each of them forms a part of a ring-like frame structure, inside which is the interior of the elevator car.

In a more refined embodiment of the concept according to the invention the elevator car comprises a casing plate, which forms at least a part of the inner wall of the casing, into which casing one or more of the aforementioned luminaires, more particularly the light source of a luminaire, is disposed, and that the casing plate is arranged to be opened from above the roof of the car, for servicing, replacing or installing a luminaire, more particularly the light source of it. Thus there is access to a luminaire from the roof and working with the luminaire is ergonomical.

In a more refined embodiment of the concept according to the invention it comprises a standing platform in connection with the roof of the elevator car, which comprises a standing surface a, immediately above which is a space free of the parts of the elevator car and free of the ropes of the elevator, for enabling standing on top of the aforementioned standing surface at least when the elevator car is situated at a distance from the top end of the elevator hoistway, the structure of which standing platform rests in the vertical direction on the aforementioned at least one horizontal beam.

In a more refined embodiment of the concept according to the invention the part comprising the top surface of a beam extends at least partly to above a structure, such as to above the reflecting surface and/or the light source, of the luminaire. In this way the solution produces a very compact overall structure in the vertical direction and in the lateral direction.

In a more refined embodiment of the concept according to the invention a structure, such as a reflective surface and/or a light source, of each aforementioned luminaire is at least partly inside the channel formed by a beam. Strongly nesting in this way produces a very compact overall structure.

In a more refined embodiment of the concept according to the invention the elevator car is suspended with hoisting roping, which is connected to the elevator car with means (such as via a diverting pulley system or equipment for fixing the ropes), which are on the side of or below the elevator car. Thus the maximum load to be exerted on the roof beams can be reduced, because the supporting of the structure and the load of the car does not need to be led via them, even though the beams certainly perform the support function of the frame required by the supporting.

In a more refined embodiment of the concept according to the invention the elevator car is suspended with hoisting roping passing below the elevator car. Thus the maximum load to be exerted on the roof beams can be reduced, because the supporting of the structure and the load of the car does not need to be led via them. The roof structure can thus be formed to be very thin. The vertical bending resistance of each beam does not need to be very great.

In a more refined embodiment of the concept according to the invention the elevator car is suspended with hoisting roping, which is connected to the elevator car such that it supports the elevator car via a diverting pulley system supported on the elevator car. The diverting pulley system preferably comprises a first diverting pulley and a second diverting pulley that are supported in the proximity of two edges of the elevator car, via which diverting pulleys (e.g. implemented with 2:1 suspension) the roping travels, in which case the distribution of forces into the car is divided into at least two points. The suspension can be e.g. the skewed type.

In a more refined embodiment of the concept according to the invention the horizontal distance between the aforementioned horizontal roof beams (as measured from their parallel longitudinal sides that are nearest to each other) is at least 200 mm, and at most 700 mm, preferably at most 500 mm. Thus the roof beam structure is rigid and well suited to function as a part of a ring-like frame structure, however leaving an essential space between the beams for other use.

In a more refined embodiment of the concept according to the invention the standing platform comprises a metal plate, which is fixed to the aforementioned roof beams for connecting them rigidly to each other, and that the aforementioned plate extends horizontally from the first roof beam up to the second roof beam for essentially most of the distance of the length of the roof beams. Thus the structure is durable and the stiffening effect of the frame structure is considerable.

In a more refined embodiment of the concept according to the invention the aforementioned standing surface a is between the roof beams below their top surfaces and above their bottom surfaces. Thus the cover plate bounding the interior can be supported against the roof beams, or at least near to them, and an air gap can still be left between the plates. In this way the space of the roof of the elevator car can be efficiently utilized. Likewise the reversible bending of the plate becomes possible without bending the cover plate.

In a more refined embodiment of the concept according to the invention it comprises one or more of the aforementioned luminaires on the side of each beam, which side is on the opposite side to the aforementioned trough.

In this way the desired width of the trough and distance between roof beams can be achieved, which enables a rigid structure.

Preferably the aforementioned roof beams are in their length such that they cover at least most of the length of the elevator car.

Preferably the elevator car comprises a standing platform, which comprises a plate, which is fixed to the aforementioned roof beams, which plate comprises a standing surface.

Preferably the elevator also comprises means connected to the aforementioned one or more luminaires for supplying energy to the aforementioned one or more luminaires, which means here are thus not deemed to belong to the actual structure of the luminaire.

The elevator according to the invention is most advantageous to implement with two roof beams, but advantages are also achieved if the elevator is implemented with one roof beam. The invention can be utilized in different types of elevators, such as e.g. in elevators without a counterweight and in elevators with a counterweight. The invention can be utilized in elevators having a different suspension ratio or different suspension type, such as in elevators of the undersling type or oversling type. The elevator is most preferably an elevator applicable to the transporting of people and/or of goods, which elevator is installed in a building, to travel in a vertical, or at least essentially vertical, direction, preferably on the basis of landing calls. The aforementioned interior of the elevator car is most preferably suited to receive a passenger or a number of passengers. The elevator preferably comprises at least two, preferably more, floors to be served.

Some inventive embodiments are also presented in the descriptive section and in the drawings of the present application. The inventive content of the application can also be defined differently than in the claims presented below. The inventive content may also consist of several separate inventions, especially if the invention is considered in the light of expressions or implicit sub-tasks or from the point of view of advantages or categories of advantages achieved. In this case, some of the attributes contained in the claims below may be superfluous from the point of view of separate inventive concepts. The features of the various embodiments of the invention can be applied within the framework of the basic inventive concept in conjunction with other embodiments. Each of the additional features mentioned by a preceding embodiment can also singly and separately from the other embodiments form a separate invention.

LIST OF FIGURES

In the following, the invention will be described in detail by the aid of some examples of its embodiments with reference to the attached drawings, wherein FIG. 1 diagrammatically presents an elevator according to the invention.

Figure 2:
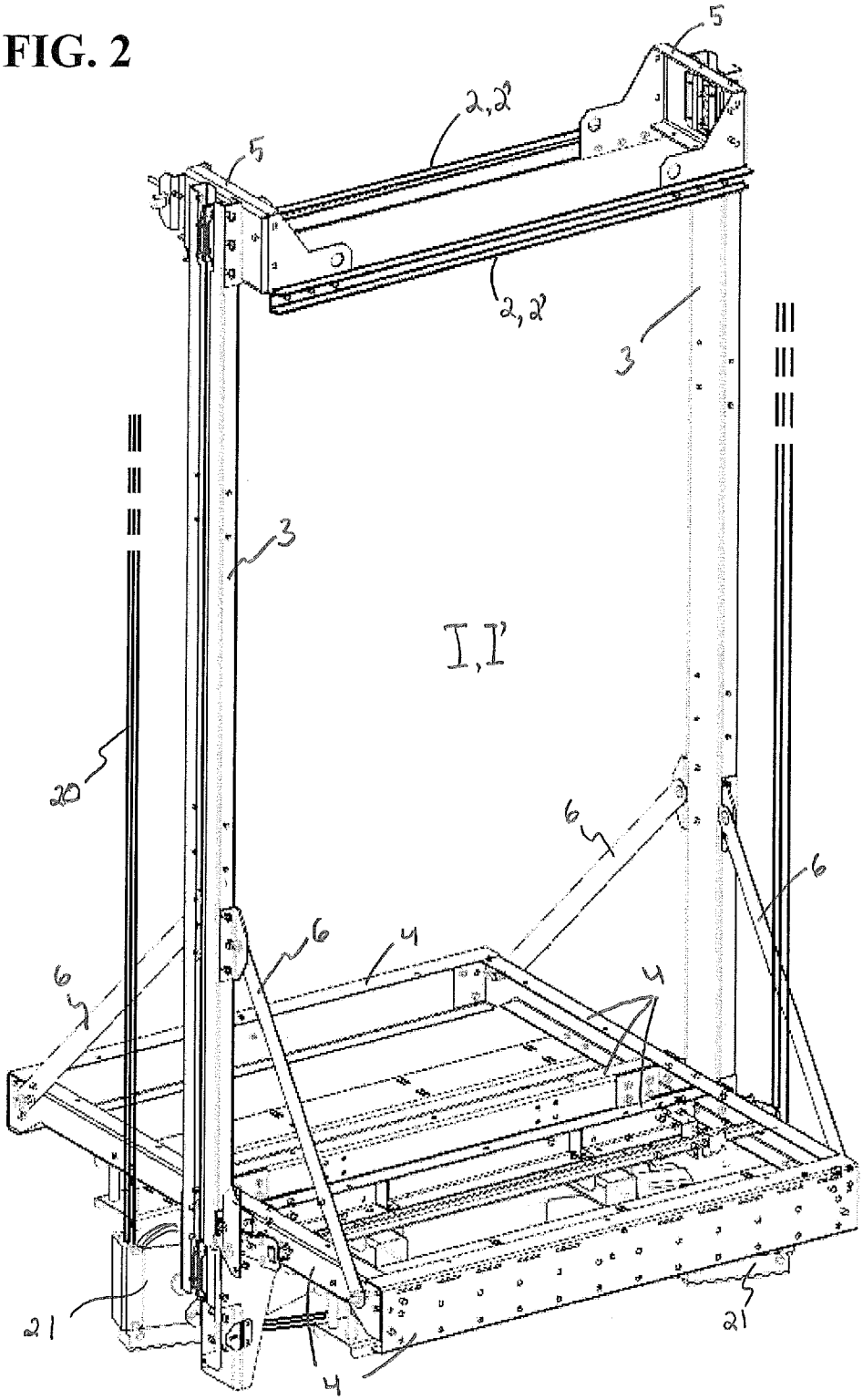

FIG. 2 presents the frame structure of an elevator car of an elevator according to the invention.

Figure 3A:
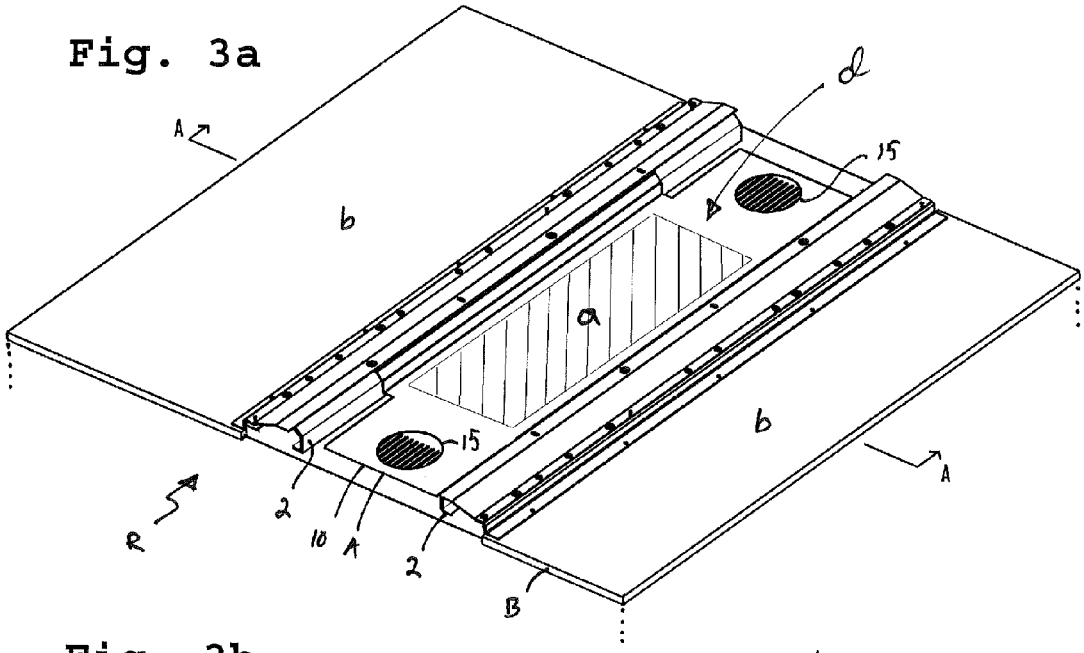

FIG. 3*a* presents a three-dimensional oblique top view of one embodiment of a roof of an elevator car of an elevator according to the invention.

Figure 3B:
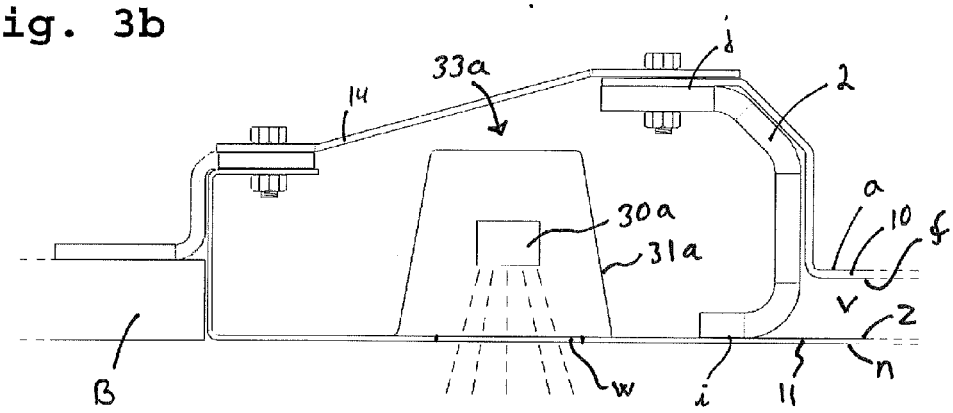

FIG. 3*b* presents a cross-section of FIG. 3*a* at the point A-A.

Figure 3C:
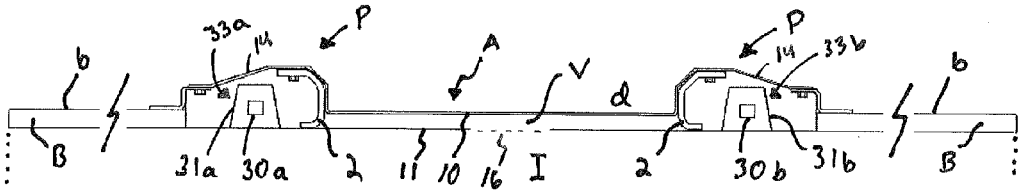

FIG. 3*c* presents a detail of the cross-section A-A of FIG. 3*b*.

Figure 4A:
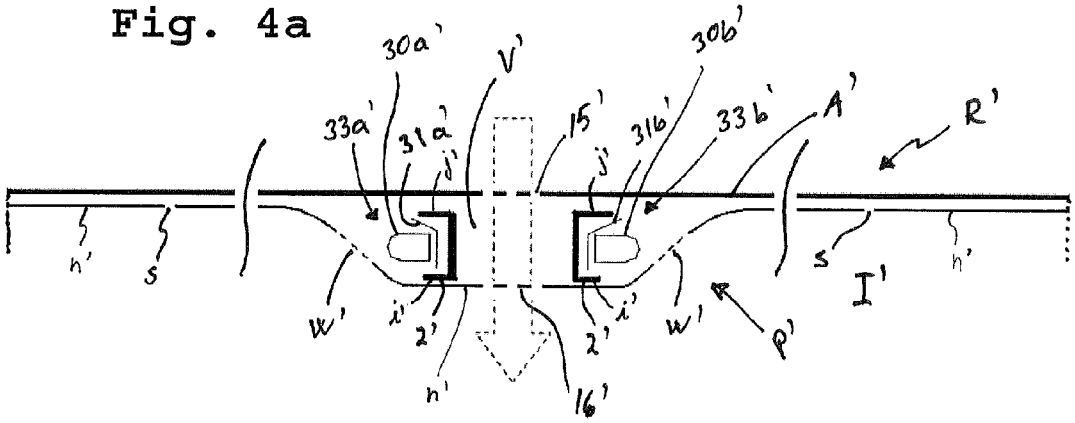

FIG. 4*a* presents a cross-section of a second embodiment of the roof of an elevator car of an elevator according to the invention.

Figure 4B:
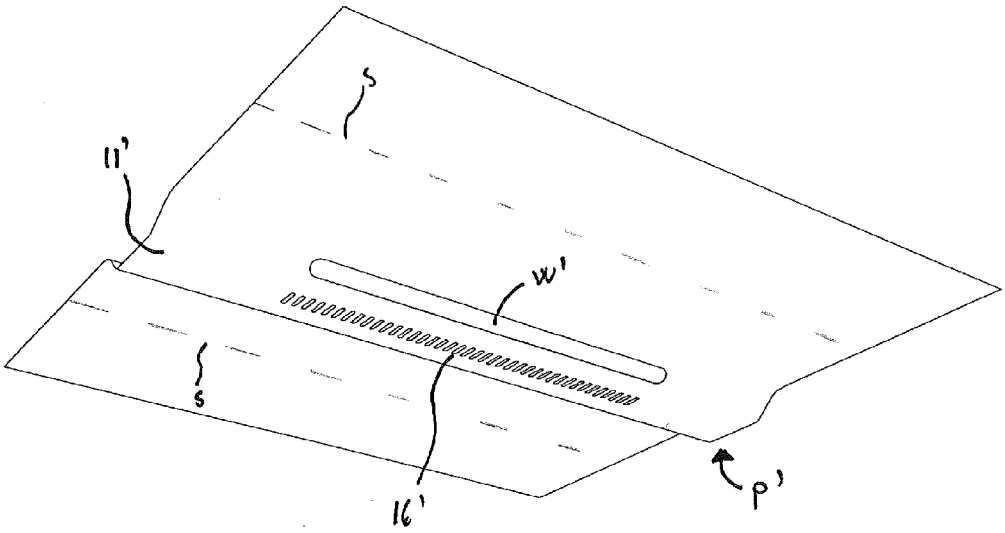

FIG. 4*b* presents a three-dimensional oblique bottom view of the cover plate of the roof of FIG. 4*a*.

DETAILED DESCRIPTION OF THE INVENTION

FIG. 1 presents an elevator according to the invention, which elevator comprises an elevator hoistway S, and an elevator car 1 arranged to move in the elevator hoistway, which elevator car 1 comprises an interior, which is bounded by the walls, roof, floor and door of the elevator car. The elevator car is moved with a hoisting machine M via hoisting ropes 20. The elevator car 1 comprises a frame structure F,F'. The frame structure F,F' comprises one or more, preferably two, parallel, horizontal, elongated roof beams 2,2' in connection with the roof R of the elevator car 1, and the vertical beams 3 of a first side and of a second side, and a floor beam system 4, which are rigidly connected to each other. A preferred structure of the frame structure F,F' (2,3,4,5,6 tai 2',3,4,5,6) is presented in FIG. 2. In the preferred embodiment presented, the frame structure F,F' comprises two parallel, horizontal, elongated roof beams 2,2', i.e. the beams 2,2' are on the same plane and in the same direction.

FIGS. 3*a*-3*c* present structural details of a first embodiment, with which an elevator according to FIG. 1 can be implemented, and FIGS. 4*a*-4*b* present structural details of a second embodiment, with which an elevator according to FIG. 1 can be implemented. The invention can, however, be utilized also in an elevator having another type of suspension. The elevator car 1 comprises one or more luminaires (33*a*,33*b*;33*a*',33*b*') for lighting the interior I of the elevator car 1, and means connected to the aforementioned one or more luminaires for supplying energy to the aforementioned one or more luminaires (not presented), which means are e.g. electricity leads from an energy source. The structure of the aforementioned one or more luminaires, preferably at least the light source 30*a*,30*b*;30*a*',30*b*' and/or reflective surface 31*a*,31*b*;31*a*',31*b*' of each of the aforementioned one or more luminaires, is at least partly, preferably at least mainly, most preferably in the manner presented wholly, by the side of the aforementioned one or more roof beams 2, i.e. in the vertical direction at the point of a roof beam of the aforementioned one or more roof beams. Thus the structure is very compact. In the solutions presented, each aforementioned roof beam 2,2' forms a part of the inner wall of the casing, into which casing a luminaire is disposed, preferably forming at least a part of the inner surface of the inner wall of the casing. The elevator car 1 comprises a first luminaire 30*a*,30*a*' or a plurality of first luminaires 30*a*,30*a*' on a first side of the aforementioned one or more roof beams 2,2' and a second luminaire 30*b*,30*b*' or a plurality of second luminaires 30*b*,30*b*' on a second side (i.e. the opposite side) of the aforementioned one or more roof beams 2,2'. In this way there is preferably a suitable amount of luminaires 33*a*,33*b*; 33*a*',33*b*' to form an elongated light source formation, e.g. covering essentially the length of each beam 2.

The frame structure F,F' is preferably according to what is presented in FIG. 2, which is a load-bearing frame structure, and is thus suited to bearing most of the forces exerted on the elevator car 1. The aforementioned one or more roof beams 2,2' comprise two parallel, horizontal, elongated roof beams 2,2' in connection with the roof R of the elevator car 1 and at a horizontal distance from each other. The roof beams 2,2' are most preferably profile beams, preferably open channel profile beams as presented, in which case they are so-called C-profile beams, but they could alternatively be closed profile beams. The C-profile beam is at least essentially the shape of a letter C in its cross-section. The profile beams 2,2' have essentially the same continuous cross-sectional profile in the longitudinal direction of the beam, the width/height ratio of which cross-section is preferably at least 0.5, preferably 0.5-1, more preferably 0.7-0.9. In this case the rigidity and space-efficiency of a beam are the best from the viewpoint of achieving a compact but rigid roof structure of the elevator car. They are preferably of metal in their material. Each aforementioned roof beam 2,2' is a channel profile beam open to the side, and one or more of the aforementioned luminaires are disposed on the channel side of each beam 2, preferably in the manner presented in FIGS. 3-4*b*. It is not, however, necessary that the luminaires are on the channel side. When the luminaires are on the channel side, the part comprising the top surface j of a beam can extend at least partly to above a structure, such as to above the reflecting surface and/or the light source, of the luminaire, as presented in FIG. 3*b* or 4*a*. The part comprising the top surface of a C-beam in each roof beam 2,2' in this case extends in the transverse direction preferably longer to the side than the part comprising the bottom surface. The roof beams 2,2' are long beams, which are in their length preferably such that they cover preferably at least most of the length of the elevator car (as measured in the longitudinal direction of a roof beam). The cross-sectional profile of each roof beam 2,2' comprises an elongated top surface j and an elongated bottom surface i.

The frame structure (2,3,4,5,6;2',3,4,5,6) comprises, as presented in FIG. 2, two parallel, horizontal, elongated roof beams 2,2' at a horizontal distance from each other, as well as the vertical beams 3 of a first side and of a second side, and a floor beam system 4, which are connected to each other such that each of them forms a part of a ring-like frame structure, inside which is the interior I of the elevator car. The roof beams 2,2' are rigidly connected to the vertical beams 3 via the frame parts 5, which support the roof beams 2,2' at a distance from each other. The frame parts 5 comprise spacer sections extending towards the sides, which sections are fitted to position the roof beams 2,2' at a greater distance from each other than if they were directly connected to the vertical beams 3. The aforementioned two roof beams 2,2' are integrated as a part of the structure of the roof such that they form a part of the roof structure bounding the interior. Wall paneling, floor paneling and/or ceiling paneling, which is/are not presented in FIG. 2, can be fixed to the frame structures 2,3,4,5,6; 2',3,4,5,6 presented. FIGS. 3*a*-4*b* present in more detail the structure of the roof R,R' with the parts connected to the roof.

In the embodiments according to both FIGS. 3*a*-3*c* and FIGS. 4*a*-4*b* there is preferably a free space V,V' between the parallel roof beams 2,2', in which space air between the interior I,I' and the elevator hoistway S or data cables and/or electricity cables is/are led to travel, e.g. to devices, such as to a fan, to luminaires and/or to service-drive control means (not presented) of the elevator car, that are on the roof of the elevator car or in connection with the roof. The elevator car 1 further comprises a cover plate 11,11' below the aforementioned at least one or more horizontal beams 2,2', which cover plate comprises a bottom surface, which forms a surface bounding the interior, and ventilation ducts 16,16', which lead, preferably through the cover plate 11,11', from the aforementioned free space between the roof beams 2,2' and above the cover plate, into the interior I,I' of the elevator car. The aforementioned ventilation ducts 16,16' are preferably apertures made in the cover plate 11,11'. The elevator car 1 comprises a platform A,A', which platform A,A' is preferably a standing platform, below which platform A is the aforementioned free space V,V' between the roof beams 2,2'. The elevator car 1 comprises ventilation ducts 15,15' for conducting air into the car, which ducts lead from the elevator hoistway S into the aforementioned free space V,V' between the roof beams 2,2', which ventilation ducts are preferably apertures made in the aforementioned platform A,A'.

The elevator car 1 comprises a cover plate 11,11' below the aforementioned one or more horizontal beams 2,2', which cover plate comprises a bottom surface, which forms a surface bounding the interior. The cover plate 11,11' is supported against the aforementioned roof beams 2,2' from below. The cover plate 11,11' can be essentially one-piece, in which case the cover plate is one fixed plate-type part, the bottom surface of which forms the aforementioned surface bounding the interior, or multi-piece, in which case the aforementioned cover plate 11,11' consists of parallel, plate-type, cover-plate parts, which might be detachable from each other or detachable from the roof separately to each other. The cover plate 11,11' comprises one or more translucent windows w,w', via which the light of the aforementioned one or more luminaires 33*a*,33*b*;33*a*',33*b*' is arranged to travel into the interior I,I' of the elevator car 1. The aforementioned translucent window w,w' preferably comprises a diffuser, e.g. a diffuser sheet or diffuser film, via which the light of the aforementioned luminaire is arranged to travel into the interior of the elevator car. The cover plate 11,11' is preferably a metal plate, in which the aforementioned one or more windows w,w' are formed.

Embodiment of FIGS. 3*a*-3*c*

In the embodiment of FIGS. 3*a*-3*c* the frame structure comprises two parallel, horizontal, elongated roof beams 2 in connection with the roof R of the elevator car 1, said beams being integrated as a part of the structure of the roof and at a horizontal distance from each other, between which roof beams 2 is an upward-opening elongated trough d, which comprises an upward-facing base surface and side surfaces. The trough d is the space between the beams 2, which space has a base surface, which is essentially (preferably at least 30 mm, more preferably more) lower than the top surfaces j of the roof beams 2. The elevator car also comprises a side platform B, which is preferably a standing platform, on the side of each roof beam 2, which side is on the opposite side to the aforementioned trough d, and each aforementioned roof beam 2 together with its possible casing forms an elongated ridge p between a side platform B and the trough d, which ridge extends to above the surface a of the base of the trough and to above the horizontal top surfaces b comprised in the side platforms B, which surfaces are preferably standing surfaces. The horizontal top surface b comprised in the side platform B is essentially below the level of the top surfaces j of the roof beams 2. The elevator car comprises one or more luminaires 33*a*,33*b*, which are at least partly inside the ridge p. There is one ridge p per each beam 2, i.e. two, and they are parallel. In this way a durable frame structure is achieved at the same time, however, forming a large usable space above the elevator car. The structure of the ridges p is similar, but a mirror image symmetrically on different sides of the trough d. Each ridge p comprises essentially the same continuous profile in its longitudinal direction, which profile preferably continues essentially the same for most of the length of the car in the longitudinal direction of the ridge.

As presented in FIGS. 3*b*-3*c*, the elevator car comprises a first luminaire or a plurality of first luminaires 30*a*, on a first side of the roof beams 2 and a second luminaire or a plurality of second luminaires 30*b* on a second side of the roof beams 2. The structure of each aforementioned first and second luminaire extends to above the level of the top surface a comprised in the elevator car, which top surface can be a standing surface. It comprises in this case the aforementioned one or more of the aforementioned luminaires on the side of each beam 2, which side is on the opposite side to the aforementioned trough d. FIG. 3*b* presents a cross-section of a ridge, which describes how a luminaire 33*a* is disposed in connection with each ridge p, inside it. In this case the structure of the aforementioned at least one luminaire, preferably at least the light source 30*a* and possibly the reflective surface 31*a* of the luminaire, is beside the roof beam 2 in the vertical direction. The light source 30*a*, 30*b* can be a LED, in which case the reflective surface 31*a*,31*b* is not necessary, or a fluorescent tube, in which case a reflective surface 31*a*,31*b* is preferably present. With this structure a very compact overall structure is achieved. As presented in the figures, each roof beam 2 forms a part of the inner wall of the casing, into which casing a luminaire is disposed, forming at least a part of the inner surface of the inner wall of the casing. Each roof beam 2 is a channel profile open to the side, into the channel side of which profile at least one of the aforementioned luminaires 33*a*;33*b* is disposed. As presented, the ridge p preferably comprises a casing, which comprises a casing plate 14. The casing plate 14, which forms a part of the inner wall of the casing of a luminaire 33*a*, into which casing the aforementioned luminaire is disposed, can preferably be opened from above, from the roof of the car. Thus the servicing, replacement or installation of luminaires can be performed from the roof. The casing plate 14 extends from the direction of the side platform to preferably over the roof beam 2, and is fixed to it in an openable manner. The casing plate 14 is in this case preferably a part fixed to the structure forming the side platform B. The casing could alternatively be a fixed part of the structure forming the side platform B.

The plate 10 comprised in the elevator car can also be counted as a part of the frame structure, which plate connects the beams 2 to each other (presented in FIG. 3, among others), and which is fixed from a number of points to the beams and stiffens the frame structure, and which plate forms the aforementioned platform A and comprises the aforementioned surface a. If it is desired to utilize the trough d for standing, the trough d can be essentially empty of elevator components. In this case the platform A is a standing platform and the surface a of it is a standing surface and immediately above the standing surface a is a space free of the parts of the elevator car 1 and free of the ropes of the elevator. The free space extends in the shape of a standing surface a to suitably high above the standing surface a between the roof beams 2, preferably at least 1.8 m when the car is at a distance from the top end of the elevator hoistway. It is possible in this case to stand on top of the standing surface a without obstruction from the elevator car or from the parts moving along with it at least when the elevator car 1 is located at a suitable distance from the top end of the elevator hoistway S, e.g. when driving with service drive or when the car has stopped at a distance from the end of the hoistway or if the top clearances are spacious when the car is in its top position. The elevator car 1 is in this case preferably suspended with hoisting roping 20, which is connected to the elevator car 1 such that it passes at a distance from the trough d. For this purpose the roping 20 preferably suspends the elevator car 1 from elsewhere than above the trough d, e.g. via the diverting pulley system 21 as presented, which diverting pulley system is supported on the frame at a distance from the aforementioned trough such that the diverting pulley system, or the part of the roping arriving at it or leaving from it, travels above the base of the trough d. For this purpose the diverting pulley system 21 is supported below the level of the roof of the elevator car, on the floor beam system 4 of the elevator car such that the hoisting roping 20 passes below the elevator car 1.

The platform A is formed from a plate 10, preferably from a metal plate, which, in respect of its internal structure and its fixings, withstands without breaking someone standing on top of the top surface it comprises. The plate comprises a standing surface a, which is the top surface of the plate, and a bottom surface f. Partly for enabling standing in the trough and/or generally for achieving an intensely compact structure, the surface a of the platform A is essentially below the level of the top surfaces j of the roof beams 2. The surface a is preferably above the level of the bottom surfaces i of the roof beams 2 for creating a free space V below the platform A. The plate 10 is preferably placed such that the aforementioned bottom surface f, which is horizontal, is essentially flush with the bottom surfaces i of the roof beams 2 or above the level of them and extends horizontally from a first roof beam 2 up to a second roof beam 2. Thus the plate 10 comprises a horizontal section, which forms the aforementioned base surface of the trough d, and comprises the aforementioned surface a forming a horizontal stiffener between the roof beams 2. Thus the plate 10 prevents the beams 2 from buckling and effectively prevents them moving closer to each other by forming a compression resistance. The plate 10 is supported with this type of cross-section, which preferably continues for most of the distance of the beams 2. The plate further comprises sections extending to above the roof beams, which sections comprise bottom surfaces that are placed against the top surfaces of the roof beams. In addition, the plate 10 is preferably fixed to the roof beams for most of the distance of the roof beams 2 (preferably with a plurality of fixings at regular intervals), so that it forms an effective stiffener between the roof beams 2, also resisting movement of the beams away from each other. For the purposes of the fixing the plate 10 closely follows, on the trough d side, the surface of each beam and rises and bends along with the surface of the beam to on top of the beam 2. The plate 10 thus rests on top of the roof beams. The bottom surface f of the plate 10 bends upwards and the plate leans against the vertical surface o of the roof beam 2. In this way an extensive contact surface is formed between the plate 10 and the beam 2, and the plate 10 effectively prevents the beams 2 from moving closer to each other.

The elevator car 1 comprises a cover plate 11 below the plate 10 forming the aforementioned platform A, which cover plate comprises a bottom surface n, which forms a surface bounding the interior I, and the bottom surface f of the plate 10 and the top surface z of the cover plate 11 are at a vertical distance from each other such that a space V is formed between them. The space V allows reversible bending of the plate 10 when standing on it. Another advantage is also that in the space V air can be conducted into the elevator car or out of it, or wires can be disposed in the space. The cover plate 11 is supported against the aforementioned roof beams 2 from below. With the structure presented, the following can be achieved: the distance between the surface a and the surface n can be formed to be very small and to be efficiently utilized.

The trough d preferably forms an elongated space, which covers at least most of the length of the elevator car (measured in the direction of the trough). Preferably each ridge p extends to at most 50 mm above the aforementioned surface a and/or b. The width of the ridge is preferably at most 250 mm, preferably at most 200 mm. The horizontal top surface b comprised in the side platform B is preferably essentially above the level of the bottom surface i of the roof beams 2. In this way the structure of the side platform B is at least partly, preferably essentially wholly, beside the roof beams 2 and a compact structure is achieved. In this case also the bottom surface of it, which preferably forms the downward-facing surface bounding the interior I of the car, can be brought well upwards for enlarging the interior I of the car. The ends of the trough d can comprise, as presented, ventilation ducts 16 in the plate 10, via which ducts air can be transferred between the interior I of the elevator car and the elevator hoistway S. The ventilation ducts 16 lead to the space v and the ventilation ducts 15, which lead from the space into the interior I are preferably at different points in the lateral direction such that air travels a horizontal distance in the space V when traveling between the ducts 15 and 16. In this way a labyrinthine route is formed for the air and e.g. the transmission/production of noises in the space V can be controlled more easily.

Embodiment of FIGS. 4*a*-4*b*

In the embodiment of FIGS. 4*a*-4*b* the elevator car comprises a first flat bottom surface n' bounding the interior I' on a first side of the aforementioned one or more beams 2' (in this preferred embodiment 2 beams), which first flat bottom surface n' is above the level of the bottom surface(s) of the aforementioned one or more beams 2', and a second flat bottom surface n' bounding the interior I' on a second side of the aforementioned one or more beams 2', which second flat bottom surface n' is above the level of the bottom surface(s) i' of the aforementioned one or more beams 2'. The aforementioned flat bottom surfaces n' bounding the interior I' are beside the beams 2', at the point of the beams 2' in the vertical direction. Thus the roof beams are as though they are on the interior side. In this way a large top clearance of the car can be achieved without essentially compromising the interior of the elevator car. The lighting can also be brought into the same casing formed by the cover plate 11' along with the roof beams 2', in which case an elongated ridge p' that extends downwards can be formed in the roof of the elevator car, inside which ridge p' at least partly are the aforementioned one or more parallel roof beams 2' as well as the aforementioned one or more luminaires 33*a*', 33*b*'.

The cover plate 11' comprises windows w', via which the light of the aforementioned luminaires 33*a*',33*b*' is arranged to travel into the interior I' of the elevator car 1. The aforementioned translucent window w' comprises a diffuser, which scatters light. Each window w' opens towards the side with respect to the roof beam 2'. The part comprising the top surface j' of each beam 2' preferably extends to above the structure of a luminaire 33*a*',33*b*'.

The structure of the luminaire 33*a*',33*b*' is partly inside the channel formed by a beam 2'. In this way an extremely nested and very compact structure can be achieved. The channel of each beam 2' opens towards the side. Thus sideways illumination can be formed to be compact also in the lateral direction. Each luminaire 33*a*',33*b*' is between a window w' and a roof beam 2'. A reflective surface 31*a*',31*b*' can be between the light source 30*a*',30*b*' of a luminaire and a beam 2', as presented, especially preferably if the light source 30*a*',30*b*' is a fluorescent tube. The reflective surface is not necessary. In the solution of FIGS. 4*a*-4*b*, as in the solution of FIGS. 3*a*-3*c*, the light source can be e.g. a LED. A seam s (not necessary) is marked in the figures, which seam is formed if/when the cover plate 11' is formed to be of multiple pieces. The window w' is below the level of the flat surfaces on the different sides of the beams 2' and opens to the side, preferably obliquely, as presented, so that illumination of the aforementioned flat surfaces works effectively via the window. Thus the creation of indirect lighting can be implemented space-efficiently in the interior I' of the elevator car, because light is reflected from the aforementioned flat surfaces to elsewhere in the interior I'.

In FIG. 4*b* the roof beams 2' are not presented. They are of the type presented in FIGS. 2 and 4*a* and pass inside the ridge p'. Also this embodiment comprises a platform A' in connection with the roof R' of the elevator car. There is a free space V' below the platform A' between the roof beams 2'. The platform A' is preferably a standing platform A', which comprises a standing surface a', immediately above which is a space free of the parts of the elevator car 1 and free of the ropes of the elevator, for enabling standing on top of the aforementioned standing surface a at least when the elevator car 1 is situated at a distance from the top end of the elevator hoistway S, the structure of which standing platform rests in the vertical direction on the aforementioned at least one horizontal beam 2. The ventilation ducts 15', which lead from the elevator hoistway S into the aforementioned free space V' between the roof beams 2', are preferably apertures made in the aforementioned platform A'. Ventilation apertures 16' are formed in the cover plate 11', which comprises a bottom surface, which forms a surface bounding the interior I', which apertures lead, through the cover plate 11', from the aforementioned free space V' between the roof beams 2' and above the cover plate into the interior I' of the elevator car. An arrow is drawn in FIG. 4*a* to describe the passage of air from the elevator hoistway S into the space V' and onwards into the interior I', through the platform A' and the cover plate 11'. The ventilation ducts 16', which lead to the space v' and the ventilation ducts 15', which lead from the space into the interior I', are preferably at different points in the lateral direction such that air travels a horizontal distance in the space V' when traveling between the ducts 15' and 16'. In this way a labyrinthine route is formed for the air and e.g. the transmission/production of noises in the space V' can be controlled more easily. Sound damping can, for example, be installed in the space.

In this application, the term standing platform (A,A',B) refers to a platform, which is fitted to endure a person (1000N) standing on top of the standing surface (a,b) comprised in the standing platform, which standing surface is an upward-facing horizontal top surface, without causing a permanent shape deformation. It is obvious to the person skilled in the art that the invention is not limited to the embodiments described above, in which the invention is described using examples, but that many adaptations and different embodiments of the invention are possible within the frameworks of the inventive concept defined by the claims presented below.

The invention claimed is:

1. An elevator, comprising:

an elevator hoistway; and an elevator car arranged to move in the elevator hoistway in a vertical direction, the elevator car comprising:

an interior, which is bounded by at least a roof of the elevator car;

a frame structure, which comprises one or more parallel, horizontal, elongated roof beams in connection with the roof of the elevator car, each of the one or more roof beams being in the form of an elongated c-shaped channel with an elongated opening on a horizontal side thereof and having a vertical height; and one or more luminaires for lighting the interior of the elevator car, wherein each of the one or more luminaires is positioned at least partly within the elongated opening, and fits within the vertical height.

2. The elevator according to claim 1, wherein the elevator car further comprises one or more casings accommodating the one or more luminaires, and each roof beam forms a part of an inner wall of the respective casing.

3. The elevator according to claim 1, wherein the elevator car comprises a first luminaire or a plurality of first luminaires of the one or more luminaires on a first side of the one or more roof beams and a second luminaire or a plurality of second luminaires of the one or more luminaires on a second side, opposite to the first side, of the one or more roof beams.

4. The elevator according to claim 1, wherein the one or more roof beams comprise two parallel, horizontal, elongated roof beams in connection with the roof of the elevator car, the two parallel, horizontal, elongated roof beams being spaced from each other in a horizontal direction.

5. The elevator according to claim 1, wherein the one or more roof beams comprise two parallel, horizontal, elongated roof beams in connection with the roof of the elevator car, the two parallel, horizontal, elongated roof beams being spaced from each other in a horizontal direction, defining a free space therebetween, the free space being configured to allow air or data cables and/or electricity cables to travel between the interior and the elevator hoistway.

6. The elevator according to claim 5, wherein the elevator car further comprises a cover plate below the one or more roof beams, and the cover plate comprises a bottom surface, which forms a surface bounding the interior, and ventilation ducts, which lead from the free space between the roof beams and above the cover plate, into the interior of the elevator car.

7. The elevator according to claim 5, wherein the elevator car comprises a platform above the free space.

8. The elevator according to claim 5, wherein the elevator car comprises ventilation ducts, extending from the elevator hoistway into the free space between the roof beams.

9. The elevator according to claim 1, wherein the elevator car further comprises a cover plate below the one or more roof beams, the cover plate comprising a bottom surface forming a surface bounding the interior.

10. The elevator according to claim 9, wherein the one or more luminaires extend to a level below the bottom surface.

11. The elevator according to claim 9, wherein the one or more roof beams extend to a level below the bottom surface.

12. The elevator according to claim 9, wherein the cover plate comprises one or more translucent windows, via which light of the one or more luminaires is arranged to travel into the interior of the elevator car.

13. The elevator according to claim 12, wherein each of the one or more translucent windows comprises a diffuser via which light of the corresponding luminaire of the one or more luminaires is arranged to travel into the interior of the elevator car.

14. The elevator according to claim 12, wherein each of the one or more translucent windows opens from the roof beams straight to the horizontal side or obliquely to the horizontal side.

15. The elevator according to claim 1, wherein the roof comprises a platform having a flat top surface, and the one or more luminaires extend to a level above the flat top surface.

16. The elevator according to claim 1, wherein each of the one or more luminaires is between a window and a corresponding roof beam of the one or more roof beams.

17. The elevator according to claim 1, wherein the elevator car comprises a first flat bottom surface bounding the interior on a first side of the one or more roof beams, the first flat bottom surface being higher than bottom surfaces of the one or more roof beams with respect to a floor of the elevator car, and a second flat bottom surface bounding the interior on a second side of the one or more roof beams, the second flat bottom surface being higher than the bottom surfaces of the one or more roof beams with respect to the floor of the elevator car.

18. The elevator according to claim 1, wherein the one or more roof beams are profile beams having essentially the same continuous cross-sectional profile in a longitudinal direction of each roof beam, and a width/height ratio of the continuous cross-sectional profile is at least 0.5.

19. The elevator according to claim 1, wherein the one or more roof beams comprise two parallel roof beams in connection with the roof of the elevator car, the two parallel roof beams being spaced from each other in a horizontal direction, a trough being formed between the two parallel roof beams and having an upward-facing base surface, and wherein the elevator car comprises a side platform on a side, opposite to the trough, of each roof beam and each roof beam forms an elongated ridge between the corresponding side platform and the trough, the elongated ridge extending to a level above the upward-facing base surface of the trough and above horizontal top surfaces of the side platforms.

20. The elevator according to claim 19, wherein the one or more luminaires are at least partly disposed inside each elongated ridge.

21. The elevator according to claim 19, wherein each elongated ridge comprises a casing including a casing plate which forms a part of an inner wall of the casing, and each luminaire is disposed in the corresponding casing, and wherein the casing can be opened from above, from the roof of the elevator car.

22. The elevator according to claim 1, wherein the frame structure further comprises vertical beams and a floor beam system, the one or more roof beams, the vertical beams and the floor beam system being connected to each other such that each forms a part of a ring-like frame structure defining the interior of the elevator car.

23. The elevator according to claim 1, wherein the one or more of the luminaires are disposed in a casing, the elevator car comprises a casing plate, which forms at least a part of an inner wall of the casing, and the casing plate is arranged to be opened from above the roof of the car, for servicing, replacing or installing a luminaire.

24. The elevator according to claim 1, wherein the elevator car further comprises a standing platform in connection with the roof of the elevator car, the standing platform comprising a standing surface, immediately above which is a space free of parts of the elevator car and free of ropes of the elevator, for enabling standing on top of the standing surface at least when the elevator car is situated at a distance from a top end of the elevator hoistway, the standing platform resting in the vertical direction on the at least one of the one or more roof beams.

25. The elevator according to claim 1, wherein a top surface of each of the one or more roof beams extends at least partly to a level above the corresponding luminaire.

26. The elevator according to claim 1, wherein each of the one or more luminaires includes a reflective surface and/or a light source.

27. The elevator according to claim 1, wherein each roof beam is disposed inside a casing, and forms, together with the casing thereof, an elongated ridge, the elongated ridge extending upwards from the roof of the elevator car to a level above a horizontal top surface of the elevator car, and each luminaire of the one or more luminaires is positioned at least partly inside each elongated ridge.

28. The elevator according to claim 1, wherein each roof beam is disposed inside a casing, and forms, together with the casing thereof, an elongated ridge, the elongated ridge extending downwards from the roof of the elevator car to a level below a horizontal bottom surface of the roof of the elevator car, and wherein each luminaire of the one or more luminaires is positioned at least partly inside the corresponding elongated ridge.

* * * * *